United States Patent [19]

Gossler et al.

[11] Patent Number: 4,927,026

[45] Date of Patent: May 22, 1990

[54] PALLET BOX

[75] Inventors: Hans K. Gossler, Munster, Ind.; Charles P. Roberts, Springfield, Ohio

[73] Assignee: Navistar International Transportation Corp., Chicago, Ill.

[21] Appl. No.: 761,999

[22] Filed: Aug. 2, 1985

[51] Int. Cl.[5] ..... B65D 19/00

[52] U.S. Cl. ..... 206/600; 206/386; 229/23 A; 229/23 BT; 108/56.1; 108/56.3

[58] Field of Search ..... 206/386, 596, 600; 229/23 A, 23 BT, 41 R, 41 B; 108/56.1, 56.3

[56] References Cited

U.S. PATENT DOCUMENTS

| | | | |
|---|---|---|---|
| 2,131,349 | 9/1938 | Krieder Jr. | 229/23 A |
| 2,510,760 | 6/1950 | Schott | 229/23 A |
| 2,894,671 | 7/1959 | Nicholls | 206/386 |
| 2,902,199 | 9/1959 | Breton | 206/386 |
| 2,925,210 | 2/1960 | Fallert | 229/23 A |
| 3,291,364 | 12/1966 | Fischer | 206/600 |
| 3,666,164 | 5/1972 | Nederveld | 229/23 A |
| 3,797,727 | 3/1974 | Downing et al. | 229/23 A |
| 3,949,876 | 4/1976 | Heavner | 206/600 |
| 4,085,846 | 4/1978 | Williams | 206/600 |
| 4,296,860 | 10/1981 | Hsu et al. | 206/386 |
| 4,373,637 | 2/1983 | Shippell | 206/600 |
| 4,383,609 | 5/1983 | Lochmiller | 206/600 |
| 4,392,606 | 7/1983 | Fremion | 206/600 |
| 4,445,614 | 5/1984 | Mitsumori et al. | 206/600 |
| 4,880,141 | 11/1989 | Gossler et al. | 206/600 |

FOREIGN PATENT DOCUMENTS

| | | | |
|---|---|---|---|
| 1292439 | 10/1972 | United Kingdom | 229/23 BT |

*Primary Examiner*—David T. Fidei

*Attorney, Agent, or Firm*—F. David AuBuchon; Dennis K. Sullivan

[57] ABSTRACT

The present invention provides an inventive container which is attached to a pallet and can be folded on top of the pallet when in return shipment or in storage. The inventive container may be readily assembled without the use of hand tools and is sturdy enough to hold relatively heavy pieces of material in a stacked manner. The container essentially comprises a pallet crisscrossed by two cardboard floor boards which have end flaps which fold up and are then surrounded by a tubular cardboard member.

13 Claims, 1 Drawing Sheet

30
20
17

24
24
22
20
10

17
16
17
14
12

40
24
30
20'
10
5
5

40
20
17
10

PALLET BOX

The present invention relates to containers and more particularly a cardboard container which is easily assembled and upon disassembly may be folded into a very compact position.

DISCLOSURE STATEMENT

Cardboard boxes which can be combined with pallets are illustrated by Marnon U.S. Pat. No. 3,246,744, Breton U.S. Pat. No. 2,902,199, Fischer U.S. Pat. No. 3,291,364 and Williams U.S. Pat. No. 4,085,846. It is a desire of the present invention to provide a pallet cardboard box with a combination of high structural integrity, minimal cost, and maximum ease of assembly.

Marion illustrates a method and means for producing unitized load packages. Marnon is disadvantageous in that the package of Marnon is mainly for materials which can fit together in a block form and is not suitable for containers of loose non-form fitting material such as bolts. Also, Marnon requires extensive use of bands to hold the package together. Brenton illustrates a supporting pallet associated with a cardboard box. By only having flaps on two sides (Item 8 and 9, FIGS. 1 and 3) Breton's structural integrity is limited. Fischer is a pallet container which can be stacked vertically. Fischer has the disadvantage of requiring cooperating means between the retaining walls and side walls in locking the bottom and body sections together. Williams describes a container which has a separately formed floor which is attached to the pallet. Williams requires that the box flaps along the bottom edge of the box be cut out in order to fit around the floor flaps.

To provide a pallet and box container with a high level of structural integrity with very simple construction and great ease of assembly the present invention is brought forth.

SUMMARY OF THE INVENTION

The present invention provides an improved pallet cardboard box container. The pallet may be any conventional pallet. The pallet is covered by a first floor board with foldably attached end flaps. The first floor board is then transversely covered by a second floor board with foldable end flaps. The end flaps of the floor boards are folded upward and then surrounded by a cardboard tubular member. The simplified design of the present invention does not require intricate form cutting of the cardboard material. The inventive pallet cardboard container is also advantageous in that it doubles the side wall strength of the cardboard container. An embodiment of the inventive container to be described later also provides an upper surrounding horizontal border which is of aid when stacking the pallets on top of one another. The inventive box container can be readily assembled and an embodiment of the inventive container can be disassembled and stacked flat on top of the wooden pallet for storage or transport.

It is a desire of the present invention to provide a cardboard container attached to a pallet. It is also the desire of the present invention to provide a cardboard container attached to the pallet having dual sidewalls. It is another desire of the present invention to provide a pallet with cardboard container which may be readily assembled and disassembled without the use of hand tools. It is still another desire of the present invention to provide a pallet and cardboard container which can be folded into a relatively flat position when disassembled.

Other desires and advantages of the present invention will become apparent to those skilled in the art as the nature of the invention is better understood from the accompanying drawings and detailed description.

DETAIL DESCRIPTION OF THE DRAWINGS

Figures 1, 2, 3, 4, 5:
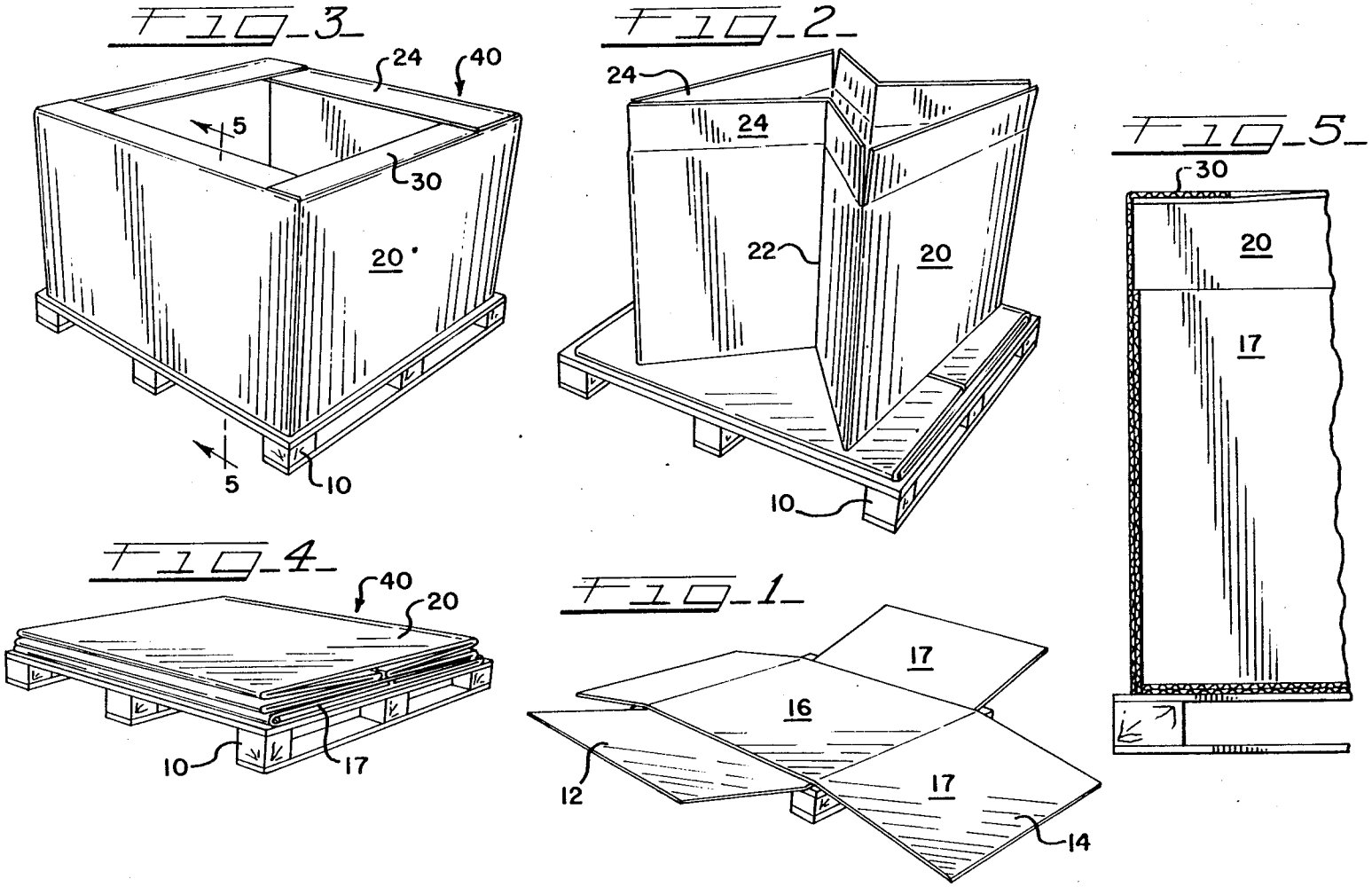
FIG. 1 is a perspective view of the pallet with the accompanying cardboard floor sheets attached to the same.
FIG. 2 is a perspective view of the top portion of the container being readied for assembly.
FIG. 3 is a perspective view of the assembled container.
FIG. 4 is a perspective view of the container in a disassembled state with the top member stacked on top of the folded floor boards for storage or transport.
FIG. 5 is a sectional view taken along line 5—5 of FIG. 3.

Referring to FIGS. 1 and 2, pallet 10 is of the conventional type rigid enough to support the loaded container and adapted to be picked up by the blades of a conventional fork lift. Covering the pallet are the cardboard floor sheets 12 and 14 A typical material used for the cardboard of this invention is 3-ply cardboard which will usually provide sufficient strength. Each cardboard floor sheet has a central portion 16 directly overlaying the pallet 10 and being generally of the same dimension of the pallet.

The floor boards 12 and 14 may be connected to the pallet 10 by any conventional means and often are stapled or nailed to the same. Each floor board has foldably extending end flaps 17 which are capable of being folded in a vertical orientation for assembly of the container, or may be folded in a horizontally overlapping fashion when being placed in storage (illustrated in FIG. 4). The floor boards 12 and 14 are placed on the pallet 10 in an orientation transverse to one another. The four end flaps 17 form four continuous sidewalls when folded vertically upward.

After folding the floor board end flaps 17 to the vertical orientation, the top tubular member 20 is opened and placed over the four floor board end flaps 12. As shown in FIG. 2 the top tubular member 20 has accordian type side folds 22 allowing the top tubular member 20 to be collapsed during storage. The top tubular member 20 will usually have a vertical length such that in its collapsed position (illustrated in FIG. 4) may be laid on top of the pallet 10 without overlaying the edges of the pallet.

The top tubular member 20 is opened and placed over the vertically folded end flaps, or as may be the case, placed over the pallet 10 and the floor board end flaps 17 will then be folded vertically upward. The top tubular member 20 is usually of such a height that the floor board end flaps 17 do not extend above the top of the tubular member 20 after assembly. In the embodiment of the container illustrated in FIG. 3, the bottom peripheral edge of the tubular member 20 makes contact with the pallet 10.

It is preferable that the top tubular number 20 have an inside dimension that provides slight interference with the vertically folded floor board end flaps 17, thereby generating a wedging action between the floor board end flaps and the top tubular member 20 which increases the structural integrity of the container.

Referring to FIGS. 2, 3 and 5 the top tubular member 20 has top vertical flaps 24 which after assembly are folded down in an alternately overlaping manner to provide a horizontal edge or trim 30 generally parallel to the pallet. This provides a top edge and also aids in the stacking pallet boxes on one another.

If desired, the floor board end flaps 17 can be fabricated to have a length equal to the vertical length of the top tubular member 20. The top horizontal edge of the floor board end flaps 17 can then also aid in supporting the horizontal trim 30, providing increased structural integrity for the container.

Referring to FIG. 4, the upper tubular member 20 has been collapsed and placed upon the horizontally folded floor board end flaps 17 of the floor boards in order to provide a compact, substantially flat position for the container 40 for shipment or storage.

While an embodiment of the present invention has been explained it will be readily apparent to those skilled in the art of the various modifications which can be made of the present invention without departing from the spirit or scope of the this application as it is encompassed by the following claims.

What is claimed is:

1. A container assembly comprising:

a rigid pallet base;

a first cardboard floor board covering said pallet and being fixably connected with said pallet, said floor board having foldable end flaps;

a second cardboard floor board covering said first floor board and being fixable connected with said pallet, said second floor board extending in a direction generally transverse to said first floor board, said second floor board having foldable end flaps; and a cardboard tubular upper member having a rectangular cross sectional area said tubular member surrounding said end flaps when folded in a vertical orientation; and wherein the inner dimensions of said tubular member cause a slight interference with said vertically folded floor board end flaps to cause a wedging action between said floor board end flaps and said tubular member.

2. A container as described in claim 1 wherein said floor boards are stapled to said pallet.

3. A container as described in claim 1 wherein said floor boards are nailed to said pallet.

4. A container as described in claim 1 wherein said tubular member has on opposite sides accordian type folds allowing said tubular member to collapse for storage upon said container disassembly.

5. A container as described in claim 1 wherein said tubular member has at its upper end foldable flaps foldable in an alternating overlapping mannner to form a fixed top frame border for said container.

6. A container as described in claim 1 wherein said floor board end flaps are of such a length to be able to fold onto said pallet without overlapping said pallet upon said container disassembly.

7. A container as described in claim 1 wherein the length of said floor board end flaps is less than the height of said tubular member.

8. A container as described in claim 4 wherein the height of said tubular member is such that it can be folded and laid on said pallet without overlapping said pallet upon disassembly of said container.

9. A container as described in claim 1 wherein said cardboard is 3-ply cardboard.

10. A container as described in claim 1 wherein the bottom peripheral edge of said top tubular member makes contact with said pallet.

11. A container assembly comprising:

a rigid pallet base with upper and lower sides;

a first cardboard floor board covering said pallet base and being fixably connected to said pallet, said floor board having foldable end flaps;

a second cardboard floor board covering said first floor board and being nailed to said pallet, said second floor board extending in a direction generally transverse to said first floor board, said second floor board having foldable end flaps; and a cardboard tubular member with a rectangular cross sectional area surrounding said floor board end flaps folded in a vertical orientation and said tubular member having on opposite sides an accordian type fold to allow said tubular member to collapse upon disassembly of said container, and said tubular member having a length such that upon disassembly it may be folded on top of said pallet without overlapping said pallet

12. A container assembly comprising:

a rigid pallet base;

a first cardboard floor board covering said pallet base and being fixably connected to said pallet, said floor board having foldable end flaps;

a second cardboard floor board covering said first floor board and being nailed to said pallet, said second floor board extending in a direction generally transverse to said first floor board, said second floor board having foldable end flaps; and a tubular member with a rectangular cross sectional area surrounding said floor board end flaps folded in a vertical orientation, and said tubular member having flaps foldable in an alternating overlapping manner to form a fixed top frame border for said container.

13. A container as described in claim 12 wherein board end flaps are of such a length that the top horizontal edge of said floor board end flaps supports said tubular member flaps.

* * * * *